US009181654B2

(12) United States Patent
Gingras

(10) Patent No.: US 9,181,654 B2
(45) Date of Patent: Nov. 10, 2015

(54) REFINER PLATE HAVING A SMOOTH, WAVE-LIKE GROOVE AND RELATED METHODS

(71) Applicant: ANDRITZ INC., Glens Falls, NY (US)

(72) Inventor: Luc Gingras, Harrogate (GB)

(73) Assignee: Andritz Inc., Glens Falls, NY (US)

( * ) Notice: Subject to any disclaimer, the term of this patent is extended or adjusted under 35 U.S.C. 154(b) by 344 days.

(21) Appl. No.: 13/888,475

(22) Filed: May 7, 2013

(65) Prior Publication Data

US 2013/0320119 A1 Dec. 5, 2013

Related U.S. Application Data

(60) Provisional application No. 61/653,194, filed on May 30, 2012.

(51) Int. Cl.

| | |
|---|---|
| ***B02C 7/12*** | (2006.01) |
| ***D21D 1/30*** | (2006.01) |
| *D21B 1/06* | (2006.01) |

(52) U.S. Cl.

CPC ..... *D21D 1/306* (2013.01); *B02C 7/12* (2013.01); *D21B 1/063* (2013.01)

(58) Field of Classification Search

CPC ..... B02C 7/00; B02C 7/02; B02C 7/12; D21D 1/30; D21D 1/303; D21D 1/306; D21B 1/063; D21B 1/14

USPC ..... 241/261.2, 261.3, 28, 24.19, 24.29, 241/296, 298

See application file for complete search history.

(56) References Cited

U.S. PATENT DOCUMENTS

| | | | |
|---|---|---|---|
| 804,738 | A | 11/1905 | Kreps |
| 827,059 | A | 7/1906 | Davis |
| 1,609,717 | A | 12/1926 | Holland-Letz |
| 4,023,737 | A | 5/1977 | Leider et al. |
| 4,712,745 | A | 12/1987 | Leith |
| 5,165,592 | A | 11/1992 | Wasikowski |
| 5,362,003 | A | 11/1994 | Virving |
| 5,425,508 | A | 6/1995 | Chaney |

(Continued)

FOREIGN PATENT DOCUMENTS

| | | |
|---|---|---|
| DE | 10 2008 039 003 | 2/2010 |
| FI | 53469 | 1/1978 |

(Continued)

OTHER PUBLICATIONS

First Examination Report cited in New Zealand Patent Application No. 610636, mailed May 29, 2013, three pages.

(Continued)

*Primary Examiner* — Faye Francis
(74) *Attorney, Agent, or Firm* — Nixon & Vanderhye P.C.

(57) ABSTRACT

A set of plate segments for refining comminuted cellulosic material including: a first plate segment and a second plate segment, wherein the first plate segment and the second plate segment each have a refining side configured to oppose the refining side on the other segment, and each of said refining sides includes a refining zone having bars and grooves between adjacent ones of the bars, wherein distance between the grooves in the first plate segment and the grooves in the second plate segment is substantially constant along an arc through the refining zone while the set is mounted to discs in a refiner.

25 Claims, 4 Drawing Sheets

(56) References Cited

U.S. PATENT DOCUMENTS

| | | | |
|---|---|---|---|
| 5,467,931 | A | 11/1995 | Dodd |
| 5,683,048 | A | 11/1997 | Virving |
| 5,690,286 | A | 11/1997 | Dodd et al. |
| 5,695,136 | A | 12/1997 | Rohden |
| 6,276,622 | B1 | 8/2001 | Obitz |
| 6,592,062 | B1 | 7/2003 | Virving |
| 7,419,112 | B2 | 9/2008 | Sjostrom et al. |
| 7,900,862 | B2 | 3/2011 | Gingras |
| 8,157,195 | B2 | 4/2012 | Gingras |
| 2006/0006265 | A1 | 1/2006 | Sabourin et al. |
| 2008/0191078 | A1* | 8/2008 | Gingras ..... 241/298 |
| 2011/0155828 | A1* | 6/2011 | Gingras ..... 241/24.29 |
| 2013/0015281 | A1* | 1/2013 | Gingras ..... 241/296 |

FOREIGN PATENT DOCUMENTS

| | | |
|---|---|---|
| SE | 513 807 | 11/2000 |
| WO | 00/56459 | 9/2000 |
| WO | 2008/098153 | 8/2008 |

OTHER PUBLICATIONS

European Search Report mailed Sep. 20, 2012.

* cited by examiner

REFINER PLATE HAVING A SMOOTH, WAVE-LIKE GROOVE AND RELATED METHODS

RELATED APPLICATION

This invention claims the benefit of U.S. provisional patent application 61/653,194, filed on May 30, 2012, the entirety of which is incorporated by reference.

BACKGROUND OF INVENTION

The invention generally relates to a disc refiner for lignocellulosic material such as wood chips. In particular, the invention relates to the grooves between adjacent refiner bars on opposing sides of plate segments mounted on the discs of the refiner or disparager.

Mechanical pulping involves mechanically separating fibers found in logs or wood chips or other lignocellulosic material. In some embodiments, such fibers may be suitable for paper making.

A common method of separating the fibers involves the use of a mechanical (or semi-chemical) refiner, which often consists of one rotating disc (e.g., a rotor) facing a stationary disc (e.g., a stator), with the rotating disc turning at speeds of approximately 900 to 2300 revolutions per minute (RPM), and in which wood material is fed into the center of the stationary disc. In some cases, both discs rotate in opposite directions, and in some other cases, there is a conical section following the flat disc surface. The discs are typically equipped with a number of replaceable segments (plate segments) positioned side by side and are mounted to the disc, these plate segments having an array of bars and grooves. The grooves generally have dams to impede the progression of wood material from the center of the plate segment inner edge to the outer edge of the plate segment. As the bars from the opposing discs cross, crossing bars impart compressive and shear forces to the lignocellulosic material. The compressive and shear forces cause separation of the larger pieces of wood material into individual fibers, development of the fibers and, to some degree, cutting of the fibers. Cutting of the fibers may not be desirable.

In the typical designs of refiner plates or plate segments (the terms plate and plate segment will be used interchangeably), both facing discs feature a certain depth of the grooves which is substantially similar on opposite plates or plate segments. The profile of the groove depths relative to the distance from the center of the disc is generally flat and planar, either substantially parallel with the top of the refining bars or at a slight deviation from parallel, such that the depth (i.e., distance from the top of the refining bar to the bottom of the groove) gradually reduces towards the periphery of the plate.

FIG. 1 illustrates a cross-sectional view of a set 100 of complementary conventional refiner plate segments 102 and 104. Unrefined lignocellulosic material 120, such as wood chip material, is fed near the conventional refiner plate inner edge 108. Refined lignocellulosic material 122 exits near the conventional refiner plate outer edge 106. Thus the material moves as illustrated in FIG. 1 from right to left. While moving as illustrated in FIG. 1, the material first encounters dams 130, 132, 134, 136, 138, and 140 in an innermost refining zone or a breaker bar zone 101. Conventional refiner plate segments 102 and 104 have a series of alternating bars 150, 152 and grooves (not shown). The tops of the bars 150, 152 of the respective conventional refiner plate segments 102, 104 face each other. As illustrated, bar 150 of conventional refiner plate segment 102 opposes bar 152 of conventional refiner plate segment 104.

Between bar 150 and bar 152 there is a gap 157 having a distance 164 between the tops of the bars. Gap 157 is generally uniform. In contrast the gap 162 between the bottoms of opposing grooves varies due to dams 154 and 156 in the grooves.

There are dams 154 and 156 on the respective conventional refiner plate segments 102, 104. These dams 154 and 156 force material traveling through the grooves defined by the respective surfaces 158 and 160 into the gap 157 and opposing conventional refiner plate segments 102, 104. As illustrated, the bottom of the opposing grooves has a distance 162. The distance between the bottom of the grooves and the tops of the respective dams, e.g. as illustrated by 166, varies along the radius illustrated in the cross section of FIG. 1. The number of dams, shape, distance, and height from the bottom of the grooves to the tops of the respective dams varies in different refiner plate designs of existing technology, based on the required retention of feed material.

Due to the centrifugal forces caused by the relative rotation of the discs, many refiner plate designs use dams in the grooves, which restrict the free flow of material in those grooves. These dams are believed to prevent unrefined material from flowing out of the discs without being mechanically treated.

Mechanical pulping can use significant amounts of energy and may produce large quantities of heat through dissipation of frictional energy. This heat transforms water from the process into steam; in most cases a substantial amount of steam is produced. The steam produced must evacuate from the refiner via the gap formed between the discs. Failure to evacuate this steam with relative ease is believed to cause mechanical vibration of the refiner, as well as process instability. In many instances, poor steam evacuation may also cause a limitation in the amount of energy that can be imparted to the lignocellulosic material, due to a limit of how much force the refiner can apply to hold the discs in close proximity to achieve the desired work. The steam may also travel together with the lignocellulosic material through the grooves in a non-rotating disc, and conventional stator refiner plates also include dams to prevent un-treated fibers from exiting the refining gap without mechanical treatment.

Refiner plates with various patterns of bars and grooves are known to those skilled in the art. See, e.g., U.S. Pat. No. 5,383,617 to Deuchars; U.S. Pat. No. 5,893,525 to Gingras; U.S. Pat. No. 6,032,888 to Deuchars; U.S. Pat. No. 6,402,071 to Gingras; U.S. Pat. No. 6,607,153 to Gingras; U.S. Pat. No. 6,616,078 to Gingras; and PCT Pub. No. WO/2010/112667 to Ruola et al.

The conventional bar, groove, and dam arrangements (e.g., as noted in the patents identified in the previous paragraph) may be effective at forcing material out of the grooves into the gap formed between the opposing discs, but the arrangements may restrict steam flow. It is believed that the path of steam flow through a refiner equipped with conventional refiner plates is turbulent (e.g., non-laminar) and may cause refiner instability. In addition, the very abrupt changes in groove depths due to dams and the short spacing between dams often results in steam flow being restricted to a very small percentage of the groove depths—thus limiting the steam evacuation efficiency.

BRIEF SUMMARY OF THE INVENTION

It is sought to develop a refiner plate, or a refiner plate combination of opposing refiner plates (for example opposing rotor and stator refiner plates) which features improved steam flow by creating a more laminar flow of steam in the grooves, while being able to bring all fibers in the gap between the opposing discs and prevent un-treated fibers.

In an aspect, there is a refiner plate segment for refining lignocellulosic material, the refiner plate segment having a plurality of adjacent bars and grooves, wherein at least two adjacent grooves have a substantially identical pattern along a substantially radial direction defined by a radial line connecting an inner edge of the refiner plate segment and an outer edge of the refiner plate segment, the substantially identical radial pattern comprising a smooth transition having at least undulation.

A novel set of refiner plate segments have been conceived and invented for refining lignocellulosic material. The refiner plate segments comprise a first refiner plate segment and a second refiner plate segment, wherein the first refiner plate segment and the second refiner plate segment each have a plurality of adjacent bars and grooves, wherein, during operation, the set of refiner plates are configured to have a substantially constant distance between a groove surface of the first plate segment and a groove surface of the second plate segment at a substantially radial distance defined by a radial line connecting an inner edge of the first or second refiner plate segment and an outer edge of the first or second refiner plate segment.

DETAILED DESCRIPTION OF THE INVENTION

Figure 1:
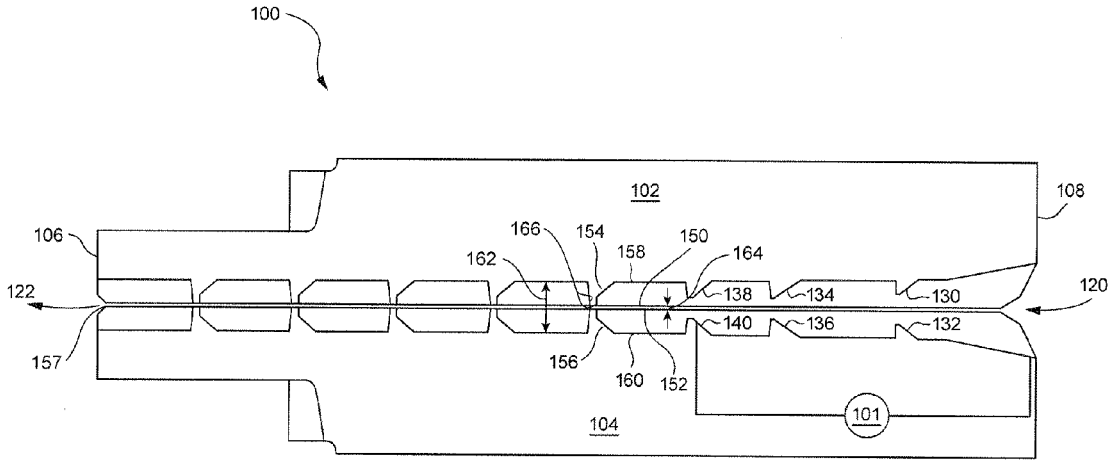
FIG. 1 (Prior Art)
FIG. 1 is a cross-sectional view of a conventional arrangement of a set of refiner plate segments.

A refiner plate (or a refiner plate segment) has been conceived that features a smooth groove depth profile on opposing plates with minimal or no abrupt changes in the relative groove depths between opposing plates. A smooth groove depth profile may be embodied by a substantially uniform gap, e.g., within 10 to 20 percent of the dimension of the gap, along the length of gap between opposing plates. A smooth gap depth may facilitate steam flow throughout the available area in the grooves, with little potential for causing high turbulence and vibration. The smooth gap profile may be constant in each disc all around the circumference of the disc, and the profile on opposite discs may be complementary (e.g., opposite) to one another.

In such an exemplary embodiment, the deep groove areas on one disc may face or oppose the shallow groove area of the opposite disc. Thus, the groove depth profiles may be complementary to each other. Such a combination may facilitate smooth steam flow at any radial point in the gap formed between the opposing discs.

The groove depth in the deepest parts of the grooves may be 3 or more (e.g., 4, 5, 6, 7, or 8) times the depth of the shallowest points or areas. In other embodiments, the groove depth in the deepest parts of the grooves may be greater than 2.0 times, or 2.5 times the depth of the shallowest points. In the shallowest areas, the depth may be no more than 1-4 mm, e.g., no more than 2 or 3 mm.

For instance, the top of a groove surface may be substantially the same height as an adjacent bar. In such an embodiment, the distance from the top of an adjacent bar to the deepest portion of a groove (e.g., a valley) may be 15 mm, 12 mm, 10 mm, 8 mm, 6 mm or any similar value. That is, the depth of a groove may be at least 5 mm.

The top surface of the bars forming the gap between the two discs may be substantially flat and substantially parallel between the two opposing refiner plates or refining discs, generally having a relative angle of less than 1 degree and always less than 5 degrees (e.g., 2 or 3 degrees). The smooth wavy profile of the bottom of the grooves is not substantially parallel to the profile of the top of the bars. In an embodiment, the smooth wavy profile of the bottom of the grooves may be substantially parallel and thus complementary to the smooth wavy profile of the bottom of the grooves on opposite refiner plate or refiner disc.

Depending on the rotating speeds (e.g., causing centrifugal forces), the load applied (e.g., causing steam drag force), and the target energy input for the material and quality requirements, some additional flow restrictors such as dams or partial dams may be added to the areas of the refiner plates where the groove depths are shallowest. This may prevent the fibers to be transported too quickly out of the area where energy transfer is intended.

Serrated edges on the bars in the shallow area may be used to prevent fibers from traveling through this area too quickly and without sufficient refining. The serrations may protrude out from the general shape of the bars and/or may be recessed into the bars.

The combination of such a pair of refiner plates may facilitate laminar flow of the steam through the refiner plates, allowing easy evacuation of steam and good mechanical behavior of the refiner. At the same time, the combination may ensure that all fibers are being treated in the gap between the plates.

In certain embodiments, there may be a minimum of two shallow areas on one disc and one shallow area on the other disc, although any suitable number of shallow areas may be present. There can be more shallow areas on each disc, and the complementary profile does not need to extend to either the inner diameter of the refiner plates, nor does it need to extend to the outer diameter of the refiner plates.

In some embodiments, the complementary profiles may be used in the outermost part of the refiner plate segments because the inner portion may not require the added retention and increased work that the complementary groove depth profile is believed to provide.

In some embodiments, the groove depth may increase near the outer periphery of the refiner plate to increase the capacity to vent steam forward. This may be accomplished by introducing a relatively flat groove portion that is substantially parallel to the top of the adjacent refiner bars. This may also be accomplished by introducing a larger distance between complementary wavy groove profiles, such that the distance from the bottom of a groove on one plate to the bottom of a groove on its opposing plate increases near the plate periphery.

In some embodiments, there may be a combination of refiner plate designs, e.g., opposing one another in a refiner, and where either one disk is rotating while the other is stationary, or where both discs rotate in relatively opposite directions; and where the groove depth profiles are complementary between the two discs, while the top of the bars are substantially flat and parallel, and those groove depth profiles are smooth, gradual curved profiles or an approximation of such.

There also may be flow restrictors in the shallow groove areas of each opposing refiner plate to control the retention of the material to be refined.

In some embodiments, there may be a conical refining zone, where one refining element has bars and grooves on the convex surface of the cone, and where the opposing surface has bars and grooves on the concave surface facing the first convex surface.

There may be a combination of opposing refiner plates in a refiner used to process lignocellulosic material. The groove depth profiles on at least a portion the opposite refining surfaces are smooth, wavy and complementary to one another, while the bar tops forming the top surfaces of the opposite refiner plates are substantially flat and substantially parallel, and the two opposing surfaces rotate relative to one another.

The complementary profile may be an approximation of a smooth wavy profile, using a combination of relatively flat areas and relatively sloped areas.

These may be sinusoidal, for instance, although any smooth surface (e.g., not discontinuous or step-function-like) may be used. For instance, profiles similar and/or mimicking to parabolic or parametric curves may be used or any other smooth and/or curvilinear surface. The profile may represent a sloping undulation or other wave-like structure.

Similarly, the top of the undulation or wavy profile may be even (or substantially even) with top of an adjacent bar or may be beneath an adjacent bar.

In some embodiments, there may be one or more dams, e.g., in a shallow area of a groove. Such a dam may contain at least one restricting feature that can facilitate increased material retention in that location. The restrictor may be a dam, a partial dam or a serrated edge of any shape that may protrude out of the bar, or be recessed into the bar, or a combination of such features.

In an embodiment, the complementary profiles are used in the outer part of the refiner plates, e.g., the refining zone outwardly radially from the breaker bar zone.

In an embodiment, the complementary profiles do not extend all the way to the outer periphery of the refiner plates. That is, only a portion of the radius of the refiner plate segments has complementary profiles. For instance, 90 percent, 80 percent, 70 percent, 60 percent, 50 percent, 40 percent, 30 percent, 20 percent of a radius may have a substantially constant distance between groove depths of opposing plates.

In an aspect, there may be a refiner plate segment (e.g., a rotor or a stator) that one element has a minimum of one shallow area in the complementary groove depth profile area, while the opposing, complementary refiner plate segment has a minimum of two shallow areas in that profile area. Of course, each refiner plate segment may have a minimum of two shallow areas in the complementary groove depth profile area.

In an embodiment, one of the refiner plate segments rotates while the other is stationary. That is, one refiner plate segment is a rotor refiner plate segment and the other is a stator refiner plate segment. In another embodiment, there may be two rotor refiner plate segments.

In another embodiment, at least part of the refining zone is a conical zone and the complementary groove depth profile is applied in the flat portion, the conical portion, or both.

The refiner may operate at a consistency above 20 percent and/or above 30 percent. The refiner may also operate at a consistency between 6 and 20 percent or even at a consistency of 5 percent or less.

Figure 2:
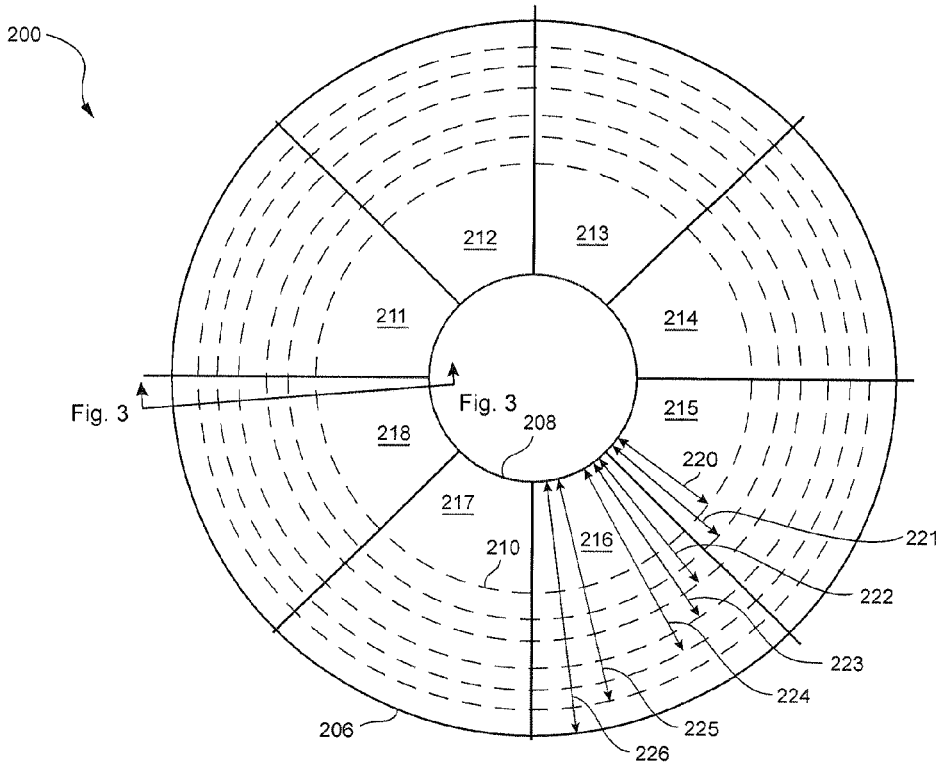
FIG. 2 is an illustrative embodiment of a plurality of refiner plate segments.
Figure 3:
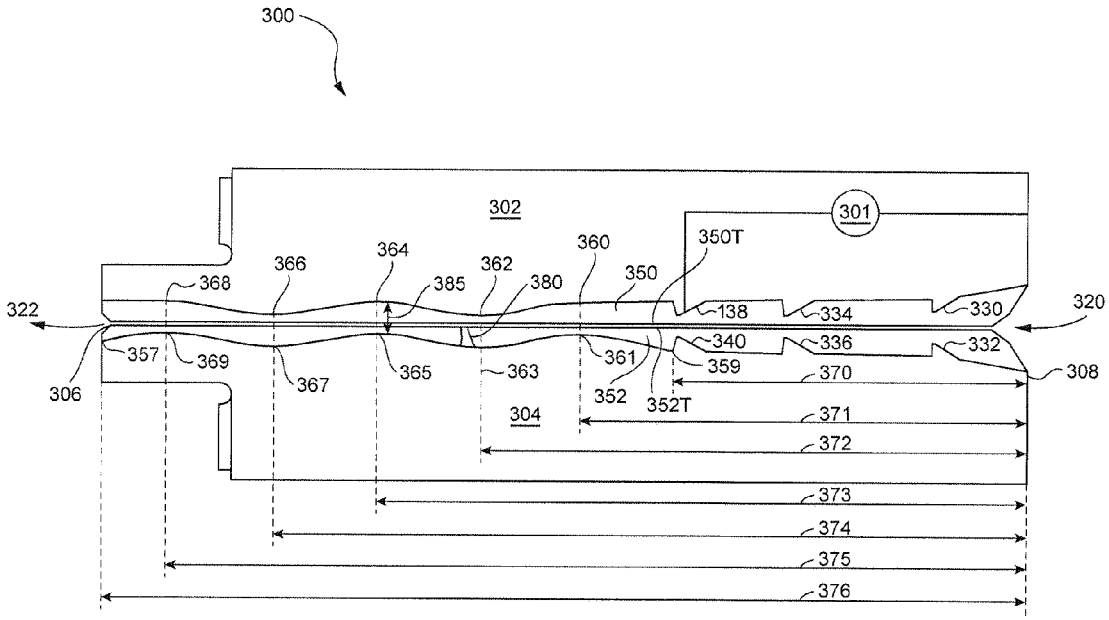
FIG. 3 is a cross-sectional view of an illustrative embodiment of a set of refiner plate segments and taken along line 3-3 shown in FIG. 2.

FIG. 2 illustrates a circular refiner plate 200 made of eight separate refiner plate segments 211, 212, 213, 214, 215, 216, 217, and 218. In other embodiments, three to twenty-four plate segments may form a circle. Although not illustrated, the refiner plate segments may have a pattern of bars and grooves in which the bars are extended in a substantially radial direction (e.g., preferably less than 25 degrees, 15 degrees, 5 degrees, or 1 degree angle from a radial direction). The bars may have a large or small feeding angle, and the particular bar configuration may be any suitable configuration for refining lignocellulosic material. FIG. 3 illustrates a cross-sectional view along the line A-A in FIG. 2. FIG. 2 illustrates that the perspective refiner plate segments form a disc having an opening in the center through which lignocellulosic material is fed. Each of the plate segments has an inner edge 208 and an outer edge 206, and the distance between the inner edge 208 and outer edge 206 is illustrated by the seventh distance 226. As illustrated in this embodiment, first distance 220 is the distance between the inner edge 208 (e.g., inner periphery) and the transition 210 between the inner zone and the refining zone. This first distance 220 of FIG. 2 corresponds to first radial distance 370 of FIG. 3.

Similarly, second distance 221 corresponds to second radial distance 371; third distance 222 corresponds to third radial distance 372; fourth distance 223 corresponds to fourth radial distance 373; fifth distance 224 corresponds to fifth radial distance 374; sixth distance 225 corresponds to sixth radial distance 375; seventh distance 226 corresponds to seventh radial distance 376, in FIGS. 2 and 3, respectively.

FIG. 3 illustrates a complementary set 300 of refiner plate segments 302 and 304. These may be a rotor and a stator although they may also be two rotors in certain embodiments. As illustrated unrefined lignocellulosic material 320 enters near inner edge 308 and exits near outer edge 306 as refined lignocellulosic material 322. As illustrated, there is an inner refining region 301 in which there may be flow restrictors or dams 330, 332, 334, 336, 338, and 340.

The cross-sectional view of FIG. 3 shows the profile of a groove (not shown) between two bars 350 and 352 on each refiner plate segment 302 and 304. The bars 350 and 352 are shown as having tops 352T and 350T. The grooves have a series of peaks and valleys which correspond with each of the radial distances 370 to 376 measured from the inner edge 308. For instance, refiner plate segment 304 has a valley 359 at first radial distance 370, a peak 361 illustrated at second radial distance 371, a valley 363 at third radial distance 372, a peak 365 at fourth radial distance 373, a valley 367 at fifth radial distance 374, a peak 369 at sixth radial distance 375, and a valley 357 at seventh radial distance 376. At the corresponding distance, refiner plate segment 302 may have an opposite peak or valley. For instance, valley 360 corresponds at the same distance to peak 361; peak 362 corresponds at the same distance to valley 363; valley 364 corresponds at the same distance to peak 365; peak 366 corresponds at the same distance to valley 367; and valley 368 corresponds at the same distance to peak 369.

In this aspect, the radius extending from peak 361 and peak 369 on refiner plate segments 304 has a constant distance to the corresponding peak or valley on refiner plate segments 302. This distance is illustrated as distance 385 between peak 365 on plate segment 304 and valley 364 on plate segments 302. This distance 385 remains substantially constant for approximately 50 percent of the refiner plate segment radius stretching from the inner edge 308 to the outer edge 306. Substantially constant does not mean perfectly constant in accordance with embodiments of this invention, and it allows for a deviation up to 20 percent, 15 percent, 10 percent, 5 percent, and/or 1 percent. Furthermore, the relative maximums and minimums need not be periodic or in a repeatable pattern. Additionally, there may be embodiments that include a dam 380 in accordance with conventional dam structures known to those skilled in the art. Dams 380 (shown in FIG. 3 in a deep area) may preferably be located in the shallow areas, rather than deep areas in order to create laminar flow in the deeper groove areas.

Although FIG. 2 illustrates an embodiment in which there is a constant groove depth at a constant radius measured from the inner or outer edge of the plate segment, e.g., such that the tops (e.g., peaks) of the groove surfaces form one or more concentric circles, it should be understood that there may be embodiments in which adjacent grooves have the same profile and embodiments in which not all grooves have the same profile, e.g., such that one or more arcs or partial concentric circles are formed.

Figure 4:
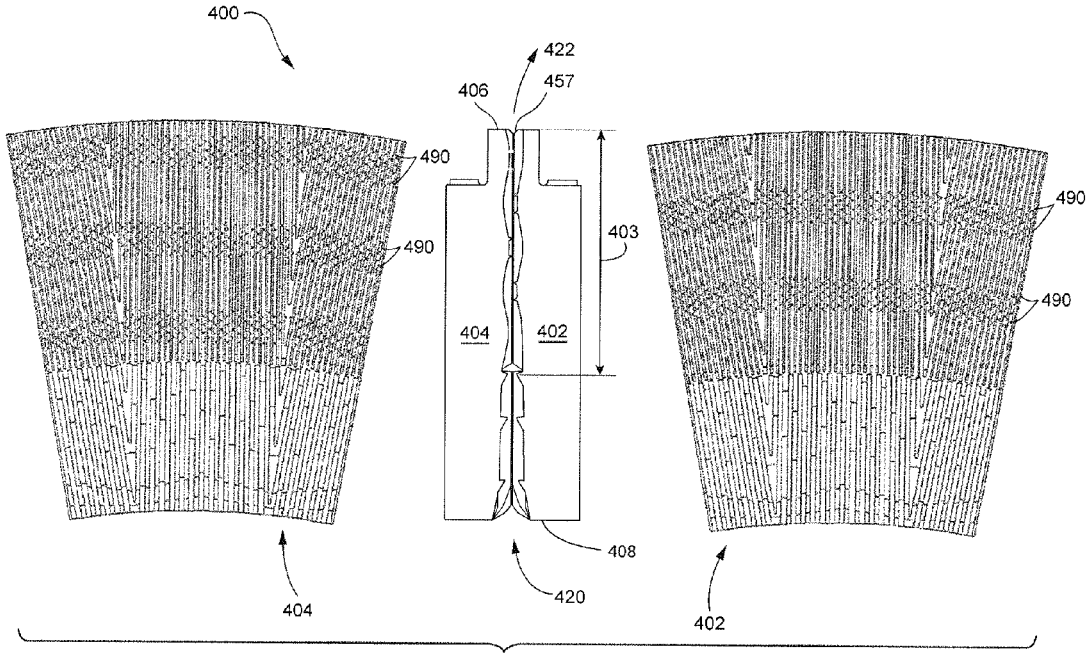
FIG. 4 is an illustrative embodiment of a set of refiner plate segments in accordance with an embodiment.

FIG. 4 illustrates an embodiment in which the set 400 has refiner plate segments 402 and 404 wherein the unrefined lignocellulosic material 420 enters from the inner edge 408 and moves through the gap 457 between the opposing refiner plate segments 402, 404. The refined lignocellulosic material 422 exits the gap 457 near the outer edge 406. In this embodiment, there exist complementary groove profiles in the outer part 403 of the refiner plate segments 402 and 404. The complementary groove profiles in the outer part 403 of the refiner plate segments 402, 404 have shallow areas containing flow restrictors 490 to hold back the lignocellulosic material within the refiner. The flow restrictions may be, for example, a full height dam or a half-height dam. Other types of flow restrictors which may be in both the shallow and deep areas of the grooves are irregular surfaces on the sidewalls of the bars, such as sidewalls having a serrated edges extending partially or fully from the bottom of groove to the upper surface of the bar, dimples or craters in the sidewall, or other irregular surface features that retard flow through the grooves.

The arrangement of refiner bars may be in accordance with any known arrangement, such as those illustrated in U.S. Pat. No. 5,383,617 to Deuchars; U.S. Pat. No. 5,893,525 to Gingras; U.S. Pat. No. 6,032,888 to Deuchars; U.S. Pat. No. 6,402,071 to Gingras; U.S. Pat. No. 6,607,153 to Gingras; and U.S. Pat. No. 6,616,078 to Gingras, the contents of each of which is incorporated herein by reference. In embodiments in which bars and grooves are not substantially aligned with a radius measured from the inner edge or periphery, it should be understood that the groove profile described herein may be applicable to the length of the groove.

In one embodiment, the invention may be a set of plate segments for refining comminuted cellulosic material comprising: a first plate segment and a second plate segment, wherein the first plate segment and the second plate segment each have a side configured to oppose a side on the other segment, and each of said sides includes a refining zone having bars, and grooves between adjacent ones of the bar, wherein a distances between the grooves in the first plate segment and the grooves in the second plate segment are substantially constant along an arc through the refining or disperser zone and while the set is mounted to a refiner or disperser. Each segment may be mounted to a disc and arranged in an annular array of segments to form a plate.

The bars of each segment may have upper surfaces aligned in a common plane. Or the plate segments may be configured for a conical refiner. The depth of all grooves in the first plate may be constant along an arc defined by a common radius. The depth of each of the grooves may gradually change along the length of the groove and the depth of each groove varies in a S-shaped pattern.

The invention may also be embodied as a set of refiner plate segments comprising: a first plate segment including a face including a refining zone comprising rows of bars and grooves between the rows and the grooves include a first deep section at a first radius from a rotational axis of the first refiner plate segment and a first shallow section at a second radius, and a second plate segment including a face configured to oppose the face of the first plate segment when the set is mounted in a refiner or disparager, wherein the grooves have a second deep groove section at the second radius and a shallow section at the first radius.

The shallow section may have a depth of no greater than four millimeters and the top of a groove surface is substantially the same height as an adjacent bar and the distance from the top of an adjacent bar to the deepest portion of a groove is at least 5 mm. There may be one or more flow restrictors such as dams or partial dams or have a serrated edge of any shape protruding out of the bar, or be recessed into the bar, or a combination of such features added to the areas of the refiner plates where the groove depths are shallowest The grooves may have a smooth groove profile with a minimum of two shallow areas on one of the segments and a minimum of one shallow area on the other segment. The complementary profiles of the opposing grooves does not need to extend to either the inner diameter of the refiner plates, nor does it need to extend to the outer diameter of the refiner plates.

The complementary profiles may be used in the outermost part of the refiner plate segments. The groove depth may increase near the outer periphery of the refiner plate to increase the capacity to vent steam forward. The groove depth may increases by introducing a relatively flat groove portion that is substantially parallel to the top of the adjacent refiner bars. The groove depth increase may be accomplished by introducing a larger distance between complementary wavy groove profiles, such that the distance from the bottom of a groove on one refiner plate segment to the bottom of a groove on its opposing plate increases near the refiner plate segment periphery. The groove depth profiles may be smooth, gradual curved profiles or an approximation of such including profiles that are sinusoidal, or mimicking parabolic or parametric curves or any other smooth and/or curvilinear surface, or a sloping undulation or other wave like structure.

An embodiment of the invention is a set of refiner discs comprising: two refiner discs each composed refiner plate segments, each refiner plate segment having a surface of bars and grooves on one side of the refiner plate segment featuring a smooth groove depth profile on opposing discs with minimal or no abrupt changes in groove depths, and wherein the smooth groove depth profile may be a smooth wavy profile of the bottom of the grooves and may be substantially parallel and thus complementary to the smooth wavy profile of the bottom of the grooves on opposite refiner plate or refiner disc. The smooth groove depth profile may be constant in each plate segment such that groove depth remains constant all around the circumference of an array of plate segments on a disc, and the profile on the opposite array of plate segments.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A set of plate segments comprising:

a first plate segment including a refining face including a refining zone comprising rows of bars and grooves, between the rows and the grooves include a first deep section at a first radius from a rotational axis of the first refiner plate segment and a first shallow section at a second radius;

a second plate segment including a refining face configured to oppose the refining face of the first plate segment when the set is mounted in a refiner, wherein the grooves have a second deep groove section at the second radius and a shallow section at the first radius; and wherein the depth of each groove varies in an S-shaped pattern.

2. The set of refiner plate segments of claim 1 wherein each plate segment is one of a plurality of plate segments configured to a plate when the segments are assembled on a disc of a refiner.

3. The set of refiner plate segments as in claim 1 wherein the bars of each segment have upper surfaces aligned in a common plane.

4. The set of plate segments as in claim 1 wherein the depth of each of the grooves changes gradually along the length of the groove.

5. The set of plate segments as in claim 1 wherein the groove depth in the first deep section is at least twice the depth of the first shallow section.

6. The set of plate segments as in claim 1 wherein the shallow section has a depth of no greater than four millimeters.

7. The set of refiner plate segments of claim 1 wherein the first and second shallow groove sections are substantially in a plane with upper surfaces of the adjacent bars and the first and second deep groove sections are at least 5 mm in depth.

8. The set of refiner plate segments of claim 1 wherein the first and second deep groove sections have a depth at least twice as deep as the first and second shallow groove sections.

9. The set of refiner plate segments of claim 1 wherein the first and second shallow groove sections each form a dam.

10. The set of refiner plate segments of claim 1 wherein the bars of at least one of the segments have sidewalls with surfaces that are at least one of jagged, serrated, dimpled, cratered or otherwise irregular.

11. The set of plate segments of claim 1 wherein the first deep section is divided by the first shallow section and the second shallow section is divided by the second deep section.

12. The set of plate segments of claim 1 wherein the first deep section and the first shallow section are both radially inward of an outer edge of the zone and radially outward of an inner edge of the zone.

13. The set of plate segments of claim 1 wherein first deep section and the second shallow section are at radially outermost regions of the segments.

14. The set of plate segments of claim 1 wherein the grooves increase in depth along radially outward direction.

15. The set of plate segments as in claim 1 wherein the grooves include a substantially planer bottom surface substantially parallel to upper surfaces of the bars.

16. The set of plate segments as in claim 1 wherein the grooves on the first plate segment are separated from the grooves of the second plate segment by a distance parallel to a rotational axis of the segments, wherein the distance gradually increases in a radially outward direction.

17. The set of plate segments as in claim 1 wherein the grooves on the first plate segment are separated from the grooves on the second plate segment by a distance along a line parallel to a rotational axis of the segments, wherein the distance varies as one of a curved profile, a S-shaped profile, a sinusoidal profile and a curvilinear profile.

18. The set of plate segments as in claim 1 wherein the segments are configured for a conical refiner.

19. The set of plate segments as in claim 1 wherein the first deep section and the first shallow section combined extend at least ninety percent of a radial length of the zone.

20. A method of refining cellulosic material using a refiner having opposing plates and a gap formed between the plates, comprising:

introducing cellulosic material through a radially inward inlet to one of the plates and into the gap, wherein an annular refining zone on a refining face of one of the plates faces across the gap an annular refining zone on a refining face of the other plate and wherein each refining zone includes an annular pattern of bars separated by grooves;

rotating at least one the plates about a rotational axis as the cellulosic material is introduced;

refining the cellulosic material as the material moves through the gap and between the refining zones, wherein the refining includes moving the cellulosic material between the bars of the opposing refining zones as the bars of one of the zones cross over the bars of the other zone;

channeling a flow of the material through the grooves during the rotation, wherein shallow sections of grooves in one of the plates are radially aligned with deep sections of the grooves in the opposite plate; and wherein the depths of the grooves vary in an S-shaped pattern.

21. The method of claim 20 wherein in the channeling step deep sections of grooves in the one of the plates are radially aligned with shallow sections of the grooves in the opposite plate; and wherein the depths of the grooves vary in an S-shaped pattern.

22. The method of claim 20 wherein the depth of each of the grooves changes gradually along a length of the groove.

23. The method of claim 20 wherein the shallow sections have a depth of no greater than four millimeters.

24. The method of claim 20 wherein the channeling includes retarding the flow by dams formed by the shallow sections.

25. The method of claim 20 wherein the deep sections are at least twice the depth of the shallow sections.

* * * * *